United States Patent [19]

Nakase et al.

[11] Patent Number: 4,811,560

[45] Date of Patent: Mar. 14, 1989

[54] EXHAUST SYSTEM FOR MARINE PROPULSION

[75] Inventors: Ryoichi Nakase; Masayoshi Nanami, both of Hamamatsu, Japan

[73] Assignee: Sanshin Kogyo Kabushiki Kaisha, Hamamatsu, Japan

[21] Appl. No.: 96,593

[22] Filed: Sep. 11, 1987

[30] Foreign Application Priority Data

Sep. 16, 1986 [JP] Japan ..... 61-215698
Sep. 16, 1986 [JP] Japan ..... 61-215700
May 7, 1987 [JP] Japan ..... 62-109906

[51] Int. Cl.[4] ..... F01N 3/04

[52] U.S. Cl. ..... 60/310; 60/320; 440/89

[58] Field of Search ..... 60/310, 320, 321; 440/89

[56] References Cited

U.S. PATENT DOCUMENTS 3,462,947 8/1969 Nowak ..... 60/314
3,765,479 10/1973 Fish ..... 60/310
4,643,685 2/1987 Nishida ..... 440/89
4,707,986 11/1987 Takada ..... 60/310

FOREIGN PATENT DOCUMENTS 35013 2/1987 Japan ..... 60/310

*Primary Examiner*—Douglas Hart
*Attorney, Agent, or Firm*—Ernest A. Beutler

[57] ABSTRACT

Several embodiment of small boats having improved exhaust systems for precluding the entry of water into the engine combustion chambers from the body of water in which the watercraft is operating. In each embodiment, the exhaust system includes a horizontally extending expansion chamber with an exhaust gas outlet whichis defined by a vertically extending tube in the expansion chamber so as to prevent the likelihood of water reentering the engines through the exhaust system. Several arrangements are disclosed for draining the water from the expansion chamber and the exhaust gases are discharged from the engine into the tunnel around the jet drive unit.

29 Claims, 6 Drawing Sheets

EXHAUST SYSTEM FOR MARINE PROPULSION

BACKGROUND OF THE INVENTION

This invention relates to an exhaust system for a marine propulsion unit and more particularly to an improved exhaust system for a small watercraft.

In many forms of watercraft it is a common practice to discharge the exhaust gases from the powering internal combustion engine into the body of water in which the watercraft is operating. This is done for a wide variety of purposes, not the least of which is the effective silencing of the exhaust gases. Although such an exhaust gas discharge is extremely convenient for many operations, it is also essential that the exhaust system provide an arrangement wherein the water from the body of water in which the watercraft is operating cannot reenter the engine through the exhaust system.

Even when the watercraft employs an above-the-water exhaust, there are many conditions when water may enter the above-the-water exhaust discharge opening and it is important to insure that water cannot enter the engine through its exhaust system even with such an above-the-water exhaust gas discharges.

In addition to the problem of water entering the exhaust system from the body of water in which the watercraft is operating, it is also a common practice with marine propulsion units to discharge at least some of the coolant from the engine into the exhaust system. This has the advantages of offering a convenient water discharge from the engine cooling system and also aids in cooling and silencing the engine exhaust gases. Again, however, it is important to insure that the water does not enter the engine combustion chamber through the exhaust system when such discharges are employed.

It is, therefore, a principle object of this invention to provide an improved exhaust system for a marine propulsion unit.

It is a further object of the invention to provide an exhaust system for a marine propulsion device wherein water is not permitted to enter the engine combustion chambers through the exhaust system.

It is a further object of this invention to provide an improved water exhaust separating system for the exhaust system of a marine propulsion device.

One particularly popular form of small watercraft is powered by a jet propulsion unit and is designed so as to be operated by a single rider. This type of watercraft is extremely maneuverable and because of its sporting nature, it is common for the watercraft to become capsized during its operation. Hence, the exhaust system for such watercraft further increase the problems of preventing the ingestion of water into the engine through its exhaust system. It is, therefore, yet a further object of this invention to provide an improved exhaust system for such a small watercraft.

SUMMARY OF THE INVENTION

A first feature of this invention is adapted to be embodied in an expansion chamber for the exhaust system of an internal combustion engine that powers a small watercraft. The expansion chamber is comprised of an outer housing that defines a generally horizontally extending expansion chamber. An exhaust gas inlet means is provided for delivering exhaust gases from the engine exhaust system into the expansion chamber into one end thereof. Exhaust gas outlet means are formed at the other end of the expansion chamber for delivering exhaust gases to the atmosphere. The exhaust gas outlet means extends through a lower wall of the outer housing and is defined by a vertically extending wall extending into the expansion chamber and which has an inlet opening disposed above the lower surface of the expansion chamber for reducing the likelihood of water entering the expansion chamber from the exhaust gas outlet means.

Another feature of the invention is also adapted to be embodied in an expansion chamber for the exhaust system of an internal combustion engine that powers a small watercraft. In connection with this feature of the invention, the expansion chamber is comprised of an outer housing that defines a generally horizontally extending expansion chamber. An exhaust gas inlet means is provided at one end of the expansion chamber for deliver exhaust gases into the expansion chamber from the engine and an exhaust gas outlet means is formed at the other end of the expansion chamber for delivery the exhaust gases from the expansion chamber to the atmosphere. In accordance with this feature of the invention, the exhaust gas inlet means comprises a megaphone section formed integrally with the outer housing.

A still further feature of the invention is adapted to be embodied in a small watercraft having a hull that defines a tunnel section and an engine compartment that is sealed from the tunnel section. A jet propulsion unit is positioned within the tunnel section and is driven by the engine for powering the watercraft. In accordance with this feature of the invention, an exhaust system is provided for the engine for deliver exhaust gases from the engine into the water through the tunnel section of the hull.

DETAILED DESCRIPTION OF THE PREFERRED EMBODIMENT OF THE INVENTION

Figure 1:
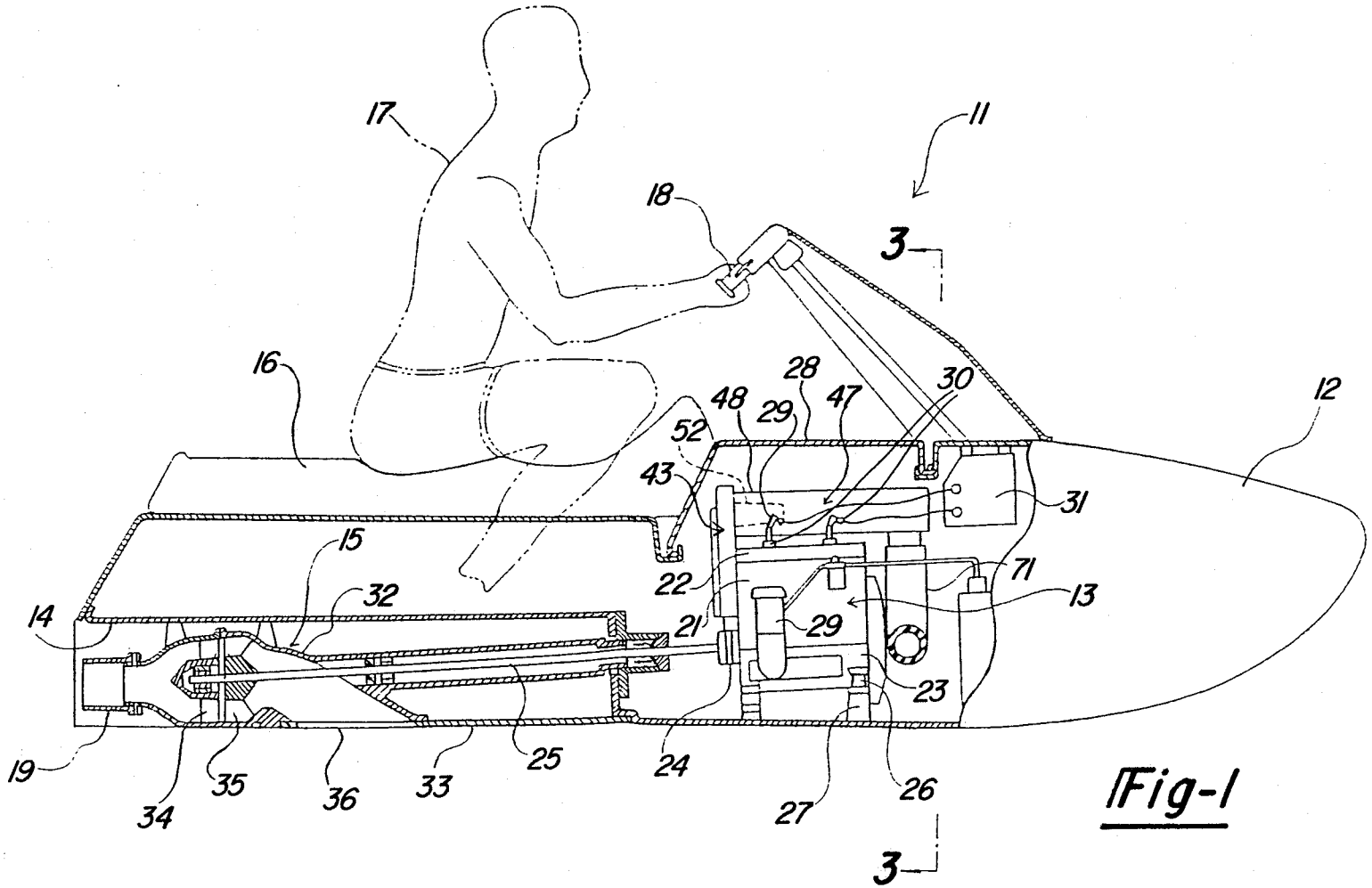
FIG. 1 is a side elevational view, with a portion broken away, of a small watercraft constructed in accordance with an embodiment of the invention.
Figure 2:
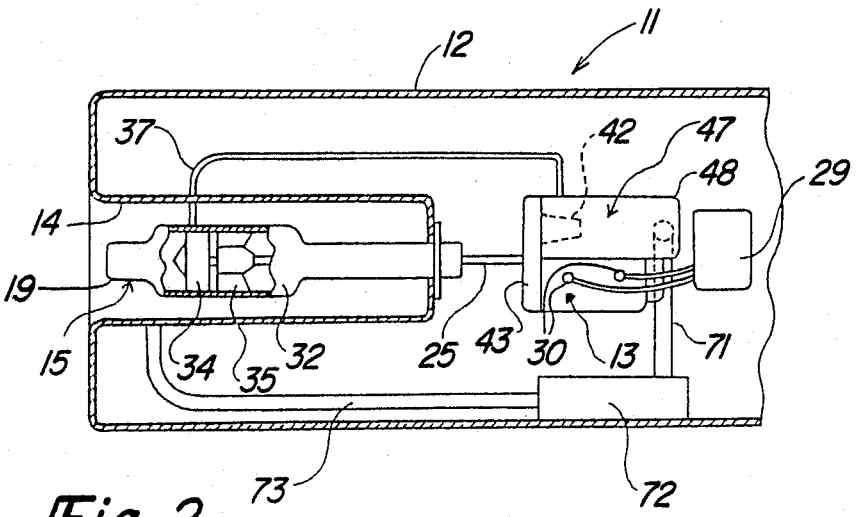
FIG. 2 is a cross-sectional view taken on a horizontal plane and on a reduced scale of a portion of the watercraft shown in FIG. 1, showing the engine, drive and related systems.

Referring first primarily to FIGS. 1 and 2, a small watercraft which forms a typical environment in which the invention may be employed is identified generally by the reference number 11. The small watercraft 11 is comprised of a hull 12 that defines a forwardly positioned engine compartment in which an internal combustion engine 13 is supported, in a manner to be described. Positioned to the rear of the engine compartment is a tunnel 14 that extends along the longitudinal center line of the hull 12 to the rear of the engine 13. A jet drive unit, indicated generally by the reference number 15 is supported within the hull tunnel 14 for powering the watercraft.

The hull 12 is provided with a seat portion 16 that overlies the tunnel 15 and which is adapted to seat a rider, shown in phantom and indicated by the reference numeral 17 in a seated, straddle position on the hull 12. A handlebar assembly 18 is positioned forwardly of the rider's seat 17 and is connected to a steering nozzle 19 of the jet drive unit 15 for steering of the watercraft 11 in a known manner.

Figure 3:
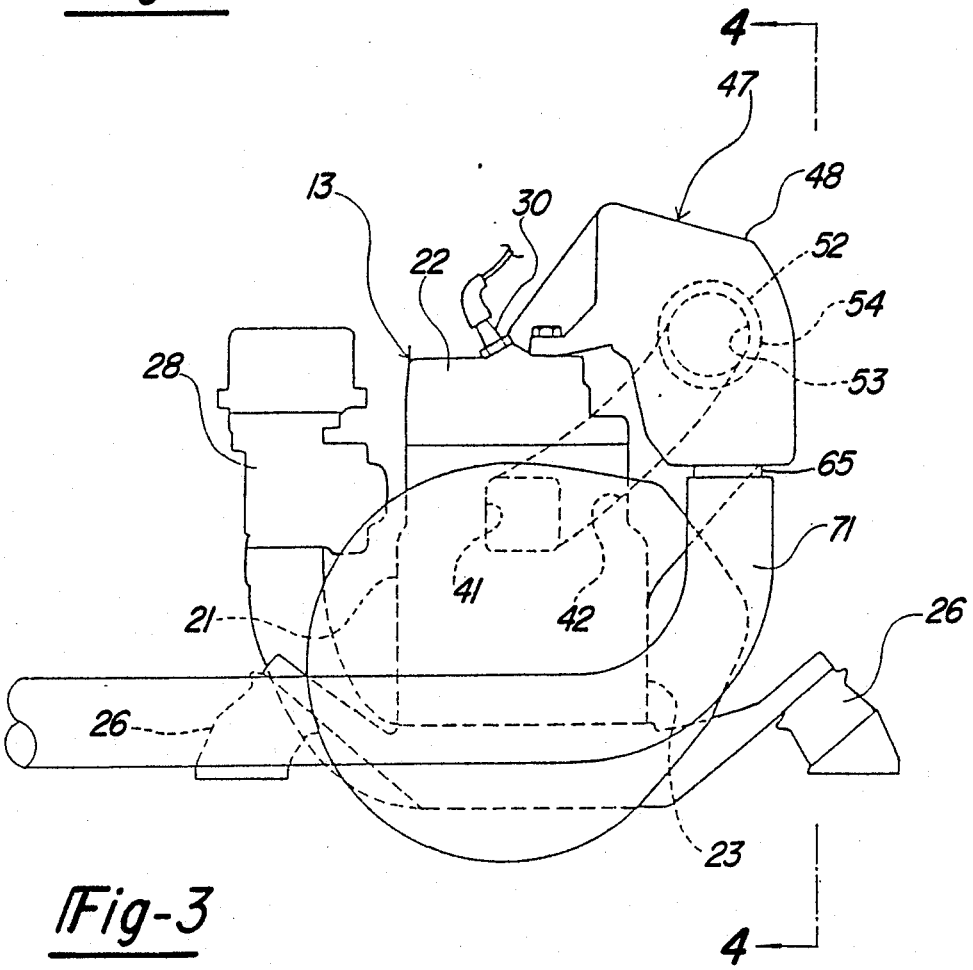
FIG. 3 is an enlarged cross-sectional view taken along the line 3—3 in FIG. 1.
Figure 4:
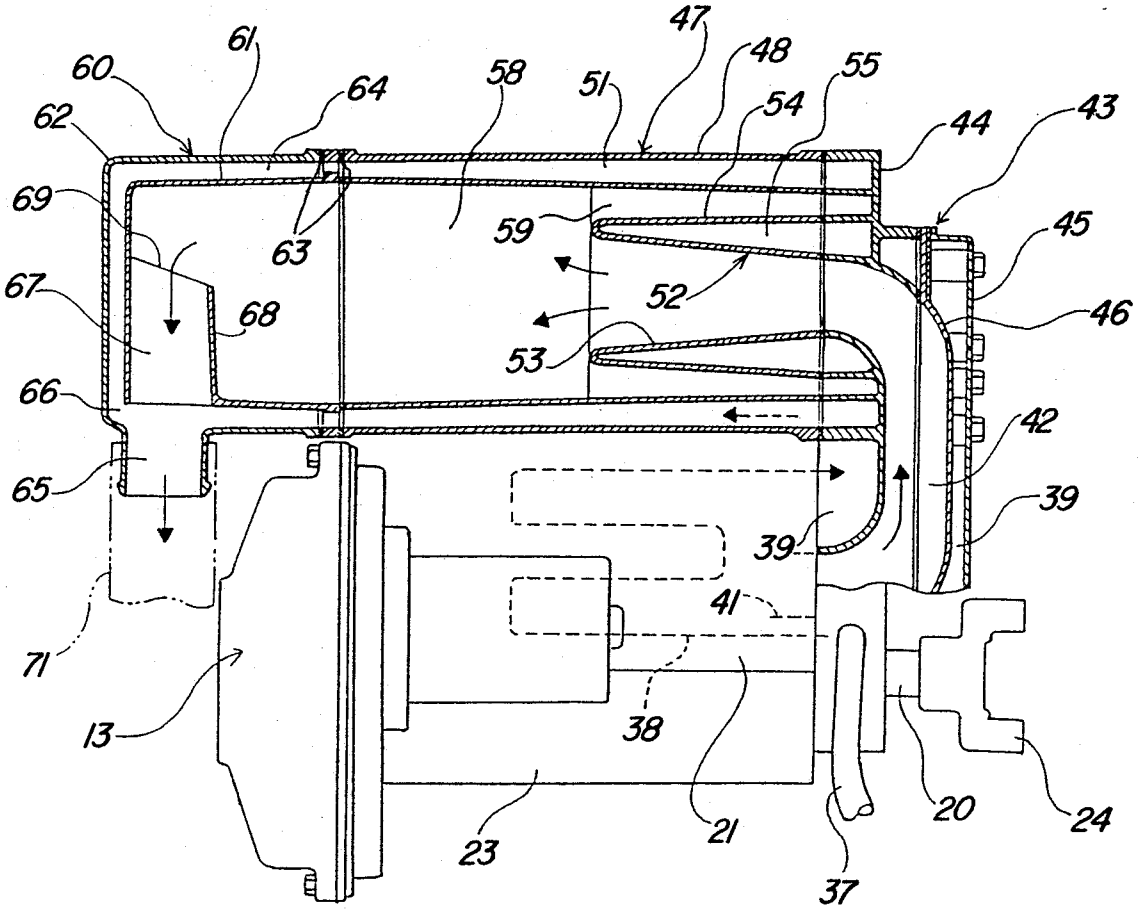
FIG. 4 is a further enlarged cross-sectional view taken along the line 4—4 of FIG. 3.

Referring now additionally to FIGS. 3 and 4, the engine 13 is, in the illustrated embodiment, depicted as being of the two-cylinder in-line crankcase compression type. It is to be understood, however, that the engine 13 may be of any known type. The engine 13 includes a cylinder block 21 to which a cylinder head 22 is affixed in a known manner. A crankcase 23 is affixed to the underside of the cylinder block 21 and rotatably journals a crankshaft (not shown) that is driven by the engine and is connected by means of a coupling 24 to a driveshaft 25 of the jet drive unit 15.

Resilient engine mounts 26 support the engine 13 on a supporting cradle 27 that is fixed within the engine compartment of the hull 12 in a known manner. It should be noted that the engine compartment is accessible through a removable hatch cover 28 for servicing of the engine.

As has been previously noted, the engine 13 is of the crankcase compression two-cycle type. To this end, there is provided one or more carburetors 29 that deliver a fuel-air charge to the crankcase 23 of the engine through a suitable intake manifold. This fuel/air charge is compressed within the crankcase and is transferred to the combustion chambers of the engine through suitable scavenge passage. Sparkplugs 30 are carried by the cylinder head 22 and are fired from a suitable ignition system, including a control box 31 for firing the fuel/air charge and powering the engine. The burnt charge is discharged from the engine through an exhaust system, to be described.

The jet drive unit 15 is comprised of a main outer housing assembly 32 that is held within the tunnel 14 in a suitable manner by means including a bottom closure plate 33 that overlies and closes the bottom portion of the tunnel 14. A plurality of stationary vanes 34 are provided within the impeller housing 32 and are disposed immediately adjacent a driven impeller 35. The impeller 35 is connected to the driveshaft 25 and draws water through an underwater inlet 36 formed in the bottom of the plate 33. The water is then discharged through the steering nozzle 19 for powering the watercraft 11 and for its steering movement as aforenoted. In the illustrated embodiment, the engine 13 is of the water-cooled type and the cooling water is drawn from the body of water in which the watercraft 11 is operating. Conveniently, the jet water in which the watercraft 11 is operating. Conveniently, the jet drive unit 15 may also function as a coolant or water pump for the engine 13 and to this end there is provided a cooling water inlet line 37 which communicates with the stator or stationary vanes 34 downstream of the impeller 35 so as to receive pressurized water. This water is delivered to the engine cooling jacket and flows in a path indicated by the broken line 38 in FIG. 4 through the cooling jacket of the engine and cylinder head. This coolant is discharged through a manifold 39, which also forms a portion of the exhaust system now to be described.

The exhaust gases from the individual cylinders of the engine 13 are discharged through exhaust ports formed in the cylinder block 21 and are collected in an exhaust manifold which is formed integrally within the cylinder block 21. This exhaust manifold terminates in a rearwardly extending discharge opening 41. Opening 41 communicates with a generally U-shaped upwardly extending exhaust passage 42 formed in a coverplate assembly, indicated generally by the reference numeral 43. The coverplate assembly 43 is comprised of a first plate 44 that is affixed against one end of the cylinder block 21 and a second, closure plate 45. The coverplate assembly 43 forms the exhaust passage 42 by means including an intermediate plate 46 of the coverplate assembly 43. The intermediate plate 46 and closure plate 45 form a water jacket through water return passage 39 around the exhaust passage 42. In this way, the exhaust gases exiting the exhaust manifold formed in the cylinder block 21 will be immediately cooled.

The upwardly curved configuration of the exhaust passage 42 acts to form a trap like configuration so as to reduce the likelihood that any cooling water, which is delivered to the exhaust system in a manner to be described, or water from the associated body of water in which the watercraft 11 is operating, may enter into the engine.

The exhaust passage 42 terminates in a first expansion device, indicated generally by the reference numeral 47 and which extends generally longitudinally of the engine and which overlies in part the cylinder head 13. Because of this configuration of the expansion device 47, it may be quite narrow in relation to the overall configuration of the engine and watercraft and thus permits a narrow configuration for the watercraft which is desirable. In addition, the positioning of the expansion device 47 outwardly from the spark plugs 30 still leaves them readily accessible through the removable hatch cover 28.

Figure 5:
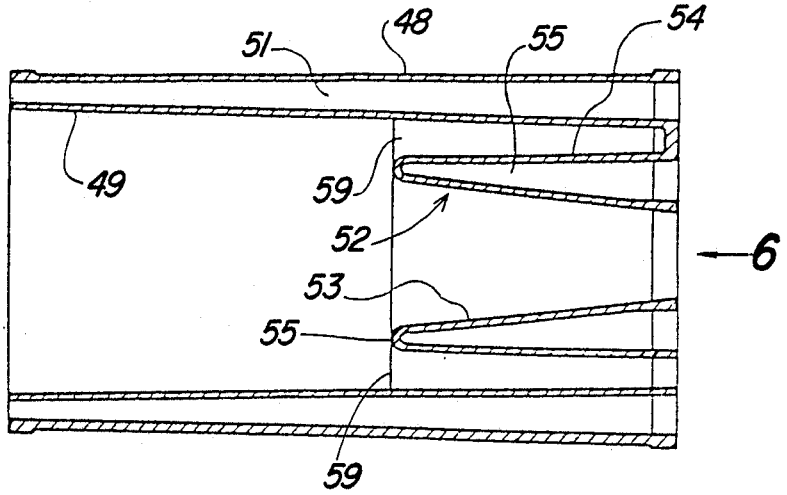
FIG. 5 is a yet further enlarged cross-sectional view taken along the same plane as FIG. 4, showing a portion of the exhaust expansion chamber.
Figure 6:
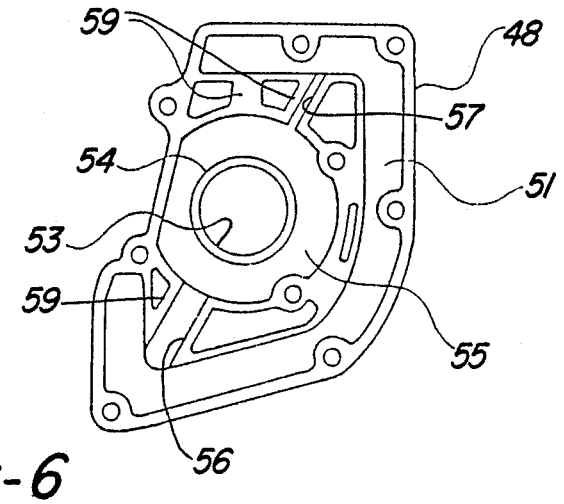
FIG. 6 is an end elevational view of the expansion chamber taken in the direction of the arrow 6 in FIG. 5.

Expansion device 47 is formed primarily by a first casting part 48 that has a configuration as best shown in FIGS. 5 and 6. The casting part 48 has generally plainer end flanges so as to mate with the coverplate assembly 43 and closure plate assembly, to be described, at the other end of the engine. An integral internal wall 49 is connected to the outer wall of the casting 48 and defines a water jacket 51 between these two walls. Coolant is delivered to the water jacket 51 in a manner to be described.

A megaphone section, indicated generally by the reference numeral 52 is formed integrally with the casting 47 and is comprised of a generally conical inner wall 53 and a reversely conical outer wall 54 which is connected to the inner wall 53 integrally by a arcuate section. A water jacket 55 is formed between the inner and outer walls 53 and 54 and communicates with the water passage 39 of the cover plate assembly 43. The water jacket 55 communicates with the water jacket 51 through a pair of water delivery passages 56 and 57 so that the megaphone section 52, as well as a total expansion chamber 58, formed by the main body portion 57, will be water cooled throughout substantially its entire length. A plurality of ribs 59 extend between the megaphone section outer wall 54 and the inner wall 49 of the outer water jacket 51 so as to interconnect these elements and so as to provide rigidity for the overall construction.

The forward end of the expansion chamber 58 is closed by means of a coverplate, indicated generally by the reference numeral 60 and comprised of an inner shell 61 that forms an extension and enclosure for the expansion chamber 58 and an outer shell 62 that forms an extension and enclosure for the water jacket 51. A suitable gasket 63 is interposed between the sections so as to provide a water jacket extension 64 through which the cooling water is passed. The outer shell is provided with a discharge nipple 65 that extends vertically downwardly. The discharge nipple 65 communicates with an area 66 formed in the outer shell 62 adjacent an exhaust gas discharge opening 67 of the inner shell 61. The exhaust gas discharge opening 67 is formed by an upwardly extending semi-cylindrical wall 68 that has a beveled rearwardly facing inlet opening 69. As a result, exhaust gases may flow through the expansion chamber 68 and downwardly through the opening 67 to communicate with the water discharged from the water jacket 51 and 59 before passing through the discharge nipple 65.

A flexible conduit 71 innerconnects the discharge nipple 65 with a second expansion chamber 72 that is positioned along one side of the hull 12 and which may be of any suitable configuration. A discharge conduit 73 extends from this second expansion chamber 72 to an area of the tunnel 14 around the jet drive unit 15 so that the exhaust gases and water from the engine cooling system will be discharged into the tunnel area and around the jet drive unit 15 for return to the body of water in which the watercraft is operating.

It should be readily apparent that the described configuration permits an underwater gas discharge, however, the reentry of water into the exhaust ports of the engine will be effectively precluded by the trap-like configuration. In addition, any water in the cooling jacket 51, 59 of the first expansion device 47 is not likely to enter into the expansion chamber 58 even if there are abrupt maneuvers because of the upstanding wall 68 and configured inlet 69. Thus, it will be insured that there is no likelihood of engine damage due to water entering the exhaust ports of the engine. In addition, the expansion chamber main casting 48 may be conveniently removed for serving and cleaning by removing the bolts (not shown) that secure the casting 48 to the cover plate assembly 43 and the cover plate assembly 59 to the casting 48. Hence, good servicing is easily accomplished. It should be noted that this servicing is facilitated by the fact that the expansion device 47 lies immediately beneath the hatch cover 28 so that servicing can be accomplished without removing the engine or exhaust system from the hull.

Figure 7:
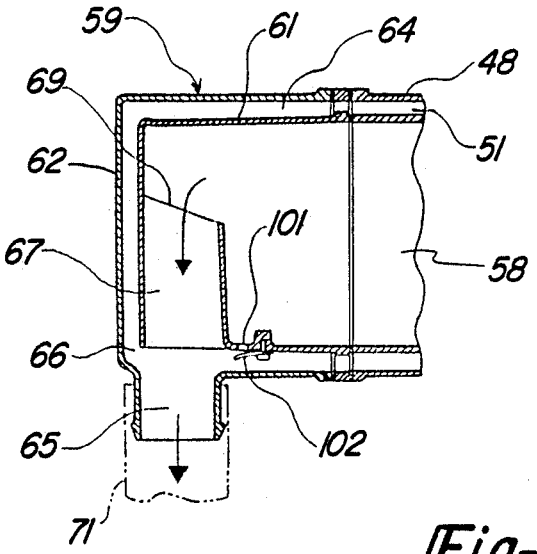
FIG. 7 is an enlarged cross-sectional view, in part, similar to FIG. 4, showing the exhaust portion of an expansion chamber constructed in accordance with yet another embodiment of the invention.

FIG. 7 shows another embodiment of the invention which is generally similar to the embodiment of FIG. 1 through 6 and, for that reason, components which are the same as the previously described embodiment have been identified by the same reference numerals. This embodiment differs from the previously described embodiment only in the provision of an arrangement for draining any water which may somehow find its way into the expansion chamber 58 back into the body of water in which the watercraft is operating through the exhaust system. Referring specifically to FIG. 7, it should be noted that the end closure 59 is provided with a drain hole 101 that is located in the lower wall of the inner shell 61 adjacent the discharge opening 67 for the exhaust gases. A reed check valve 102 is positioned on the lower side of the opening 101 so as to permit accumulated water to drain out while preventing any reverse flow.

Figure 8:
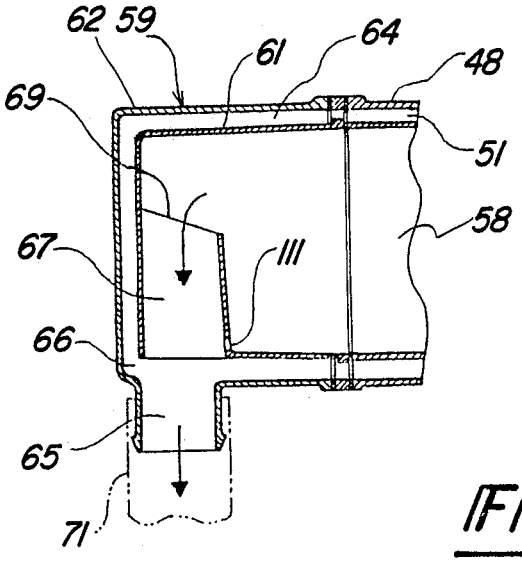
FIG. 8 is a partial cross-sectional view, in part, similar to FIG. 7, showing yet another embodiment of the invention.

Another drain embodiment is shown in FIG. 8 and this embodiment is generally similar to the embodiment of FIG. 7 and, therefore, components which are the same as the previously described embodiments have again been identified by the same reference numerals.

In this embodiment, a drain opening 111 is formed at the lower portion of the exhaust opening 67 so as to permit the water to drain from the expansion opening 58. The flow of the exhaust gases through the exhaust passage 67 will create a venturi-like effect which will aid in the water removal from the expansion chamber 58.

Figure 9:
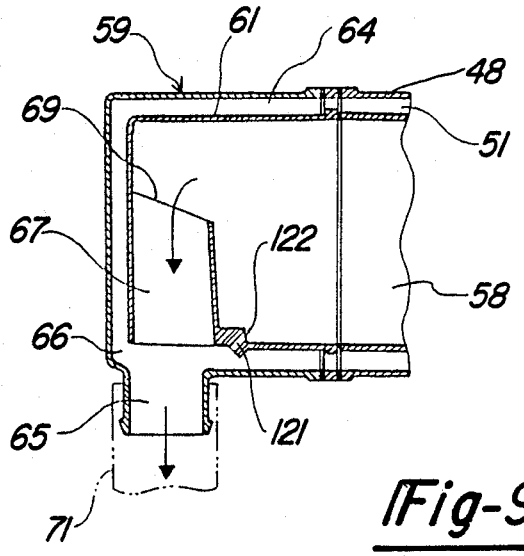
FIG. 9 is a partial cross-sectional view, in part, similar to FIGS. 7 and 8, showing a still further embodiment of the invention.

FIG. 9 shows yet another embodiment of the invention and another way in which water may be drained from the expansion chamber 58. Like the embodiments of FIGS. 7 and 8, this embodiment differs from the embodiments of FIGS. 1 through 6 only in the drain arrangement and all other components have been identified by the same reference numerals since these parts are otherwise identical.

In this embodiment, the cover plate 60 has its inner wall member 61 formed with a projection 121 in which a drain opening 122 is formed. The drain opening 122 is formed at the lower end of the exhaust discharge portion 67 and in a path where the water flow through the water jacket 64 will assist in removal of the water from the expansion chamber 58.

Figure 10:
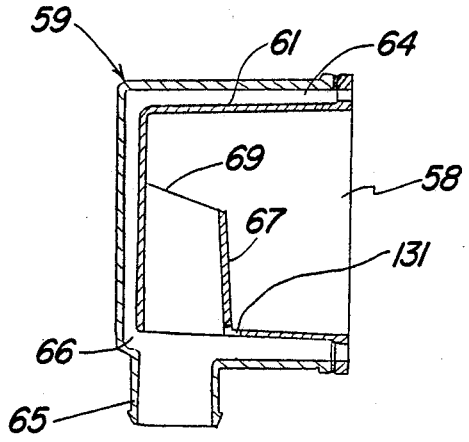
FIG. 10 is a partial cross-section view, in part, similar to FIGS. 7, 8 and 9, showing still another embodiment of the invention.

FIG. 10 shows yet another embodiment for draining water from the expansion chamber 58. In this embodiment, a drain hole 131 is disposed at the juncture between the exhaust opening 67 and the inner shell 61 so as to permit water to drain.

It should be readily apparent from the foregoing descriptions that a very effective system is provided for treating the exhaust gases from the engine of a small watercraft wherein they are effectively silenced and cooled and wherein the exhaust system will insure that water cannot enter the engine through its exhaust port. In addition, the exhaust gases are discharged in a way that they will not be objectionable nor be discharged forwardly of the operator.

Although a number of embodiments in the invention have been illustrated and described, other changes and modifications may be made without departing from the spirit and scope of the invention, as defined by the appended claims.

What is claimed is:

1. An expansion chamber for the exhaust system of an internal combustion engine powering a small watercraft, said expansion chamber being comprised of an outer housing defining a generally horizontally extending expansion chamber, exhaust gas inlet means for delivering exhaust gases into said expansion chamber at one end thereof, said exhaust gas inlet means having an opening into said expansion chamber of lesser dimensions than the cross sectional area of said expansion chamber for the expansion of exhaust gases as they enter into said expansion chamber, exhaust gas outlet means at the other end of said expansion chamber for delivering exhaust gases to the atmosphere, said exhaust gas outlet means extending through a lower wall of said outer housing and upwardly into said expansion chamber and being defined by a vertically extending wall having an inlet opening disposed above the lower surface of said expansion chamber and of smaller area than said cross sectional area of said expansion chamber for reducing the likelihood of water entering said expansion chamber from said exhaust gas outlet means.

2. An expansion chamber as set forth in claim 1 wherein the exhaust gas outlet means comprises a generally vertically extending tubular member.

3. An expansion chamber to the atmosphere as set forth in claim 1 wherein the outer housing defines a second chamber extending circumferentially around the horizontally extending expansion chamber and further including outlet means for delivering exhaust gases from said expansion chamber through said outer housing second chamber.

4. An expansion chamber as set forth in claim 3 wherein the outlet means is aligned with the exhaust gas outlet means.

5. An expansion chamber as set forth in claim 4 wherein the exhaust gas outlet means comprises a generally vertically extending tubular member.

6. An expansion chamber as set forth in claim 3 further including means for circulating cooling water through the second chamber of the expansion chamber.

7. An expansion chamber for the exhaust system of an internal combustion engine powering a small watercraft, said expansion chamber being comprised of an outer housing defining a generally horizontally extending expansion chamber, exhaust gas inlet means for delivering exhaust gases into said expansion chamber at one end thereof, exhaust gas outlet means at the other end of said expansion chamber for delivering exhaust gases to the atmosphere, said exhaust gas outlet means extending through a lower wall of said outer housing and being defined by a vertically extending wall having an inlet opening disposed above the lower surface of said expansion chamber for reducing the likelihood of water entering said expansion chamber from said exhaust gas outlet means, said outer housing defining a second chamber extending circumferentially around said horizontally extending expansion chamber, outlet means for delivering exhaust gases from said expansion chamber to the atmosphere through said outer housing second chamber, means for circulating cooling water through said second chamber and means for draining water from said expansion chamber into said second chamber.

8. An expansion chamber as set forth in claim 7 wherein the means for draining water from the expansion chamber comprises a discharge opening formed contiguous to the exhaust gas outlet means.

9. An expansion chamber as set forth in claim 8 further including check valve means cooperating with said water drain.

10. An expansion chamber as set forth in claim 8 wherein the water drain means is formed in the exhaust gas outlet means.

11. An expansion chamber as set forth in claim 8 wherein the water drain means is formed in an outwardly projecting portion of the outer housing which extends into the second chamber.

12. An expansion chamber for the exhaust system of an internal combustion engine powering a small watercraft, said expansion chamber being comprised of an outer housing defining a generally horizontally extending expansion chamber, exhaust gas inlet means comprising a megaphone section formed integrally with said outer housing for delivering exhaust gases into said expansion chamber at one end thereof, exhaust gas outlet means at the other end of said expansion chamber for delivering exhaust gases to the atmosphere, said exhaust gas outlet means extending through a lower wall of said outer housing and being defined by a vertically extending wall having an inlet opening disposed above the lower surface of said expansion chamber for reducing the likelihood of water entering said expansion chamber from said exhaust gas outlet means.

13. An expansion chamber as set forth in claim 12 wherein the megaphone section has a double wall construction.

14. An expansion chamber as set forth in claim 13 further including means for circulating cooling water through said megaphone section double wall construction.

15. An expansion chamber as set forth in claim 12 further including a cover plate affixed to the outer housing in defining an exhaust gas passage communicating with said megaphone section.

16. An expansion chamber for the exhaust system of an internal combustion engine powering a small watercraft, said expansion chamber being comprised of an outer housing defining a generally horizontally extending expansion chamber, exhaust gas inlet means for delivering exhaust gases into said expansion chamber at one end thereof comprising a megaphone section formed integrally with said outer housing, and exhaust gas outlet means at the other end of said expansion chamber for delivering exhaust gases to the atmosphere.

17. An expansion chamber as set forth in claim 16 wherein the megaphone section has a double wall construction.

18. An expansion chamber as set forth in claim 17 further including means for circulating cooling water through said megaphone section double wall construction.

19. An expansion chamber for the exhaust system as set forth in claim 16 further including a cover plate affixed to the outer housing and defining an exhaust gas passage communicating with said megaphone system.

20. An expansion chamber for the exhaust system as set forth in claim 16 wherein the outer housing is of a double walled construction defining a cooling jacket around the expansion chamber.

21. An expansion chamber for the exhaust system as set forth in claim 20 wherein the megaphone section has a double wall construction.

22. An expansion chamber for the exhaust system as set forth in claim 21 further including means for circulating cooling water through said megaphone section double wall construction.

23. An expansion chamber for the exhaust system as set forth in claim 22 further including a cover plate affixed to the outer housing and defining an exhaust gas passage communicating with said megaphone system.

24. An exhaust system for a small watercraft comprising a hull defining an engine compartment in a tunnel extending longitudinally in the watercraft and separated from the engine compartment, a jet drive unit contained within said tunnel from powering said watercraft, means for driving said jet drive unit from said engine, and an exhaust system extending from said engine to an exhaust gas outlet terminating in said tunnel means and below the level of water and externally of said jet drive unit.

25. An expansion chamber for the exhaust system of an internal combustion engine powering a small watercraft, said expansion chamber being comprised of an outer housing defining a generally horizontally extending expansion chamber, exhaust gas inlet means for delivering exhaust gases into said expansion chamber at one end thereof, exhaust gas outlet means at the other end of said expansion chamber for delivering exhaust gases to the atmosphere, said outer housing defining a second chamber extending circumferentially around said horizontally extending expansion chamber, means for circulating cooling water through said second chamber of said expansion chamber, means for draining water from said expansion chamber into said second chamber, and means for delivering exhaust gases from said expansion chamber to the atmosphere through said outer housing second chamber.

26. An expansion chamber as set forth in claim 25 wherein the means for draining water from the expansion chamber comprises a discharge opening formed contiguous to the exhaust gas outlet means.

27. An expansion chamber as set forth in claim 26 further including check valve means cooperating with said water drain.

28. An expansion chamber as set forth in claim 26 wherein the water drain means is formed in the exhaust gas outlet means.

29. An expansion chamber as set forth in claim 26 wherein the water drain means is formed in an outwardly projecting portion of the outer housing which extends into the second chamber.

* * * * *

UNITED STATES PATENT AND TRADEMARK OFFICE

CERTIFICATE OF CORRECTION

PATENT NO. : 4,811,560

DATED : March 14, 1989

INVENTOR(S) : Nakase, et al

It is certified that error appears in the above-identified patent and that said Letters Patent is hereby corrected as shown below:

Column 7, line 18, Claim 3, after "chamber" delete "to the atmosphere".

Column 7, line 23, Claim 3, after "chamber" insert --to the atmosphere--.

Signed and Sealed this

Twenty-third Day of July, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,811,560

DATED : March 14, 1989

INVENTOR(S) : Nakase, et. al.

It is certified that error appears in the above-identified patent and that said Letters Patent is hereby corrected as shown below:

Abstract, line 1, please change "embodiment" to --embodiments--

Abstract, line 7, please change "whichis" to --which is--

Background of the Invention, Column 1, line 39, please change "the" to --this--

Background of the Invention, Column 1, line 51, please change "system" to --systems--

Background of the Invention, Column 2, line 17, please change "deliver" to --delivery of--

Background of the Invention, Column 2, line 19, please change "delivery" to --delivery of--

Background of the Invention, Column 2, line 31, please change "deliver" to --delivery of--

Brief Description of The Drawings, Column 2, line 47, please change "in" to --of--

Detailed Description of the Preferred Embodiment of the Invention, Column 4, lines 3 and 4, please delete "Conveniently, the jet water in which the watercraft 11 is operating."

Detailed Description of the Preferred Embodiment of the Invention, Column 4, line 55, please change "plainer" to --planar--

Detailed Description of the Preferred Embodiment of the Invention, Column 4, line 57, please change "and" to --and a--

Detailed Description of the Preferred Embodiment of the Invention, Column 4, line 65, please change "47" to --48--

Detailed Description of the Preferred Embodiment of the Invention, Column 4, line 67, please change "a" to --an--

Detailed Description of the Preferred Embodiment of the Invention, Column 5, line 34, please change "innerconnects" to --interconnects--

Detailed Description of the Preferred Embodiment of the Invention, Column 5, line 56, please change "serving" to --servicing--

Detailed Description of the Preferred Embodiment of the Invention, Column 5, line 66, please change "FIG." to --FIGS.--

UNITED STATES PATENT AND TRADEMARK OFFICE

CERTIFICATE OF CORRECTION

PATENT NO. : 4,811,560

DATED : March 14, 1989

INVENTOR(S) : Nakase, et al.

It is certified that error appears in the above-identified patent and that said Letters Patent is hereby corrected as shown below:

Claim 7, line 13, please change "the" to –a--

Claim 9, line 3, please change "water drain" to --means for draining water--

Claim 12, line 15, please change "the" to --a--

Claim 15, line 3, please change "in" to --and--

Claim 19, line 4, please change "system" to –section--

Claim 23, line 4, please change "system" to --section--

Claim 24, line 2, please change "in" to --and--

Claim 24, line 5, please change "from" to --for--

Claim 24, line 8, please delete "means"

Claim 27, line 3, please change "drain." to --drain means.--

Signed and Sealed this

Eighth Day of May, 2001

*Attest:*

Nicholas P. Godici

NICHOLAS P. GODICI

*Attesting Officer*

*Acting Director of the United States Patent and Trademark Office*